US011415906B2

(12) United States Patent
Sato

(10) Patent No.: US 11,415,906 B2
(45) Date of Patent: Aug. 16, 2022

(54) IMAGE FORMING APPARATUS

(71) Applicant: BROTHER KOGYO KABUSHIKI KAISHA, Nagoya (JP)

(72) Inventor: Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/198,316

(22) Filed: Mar. 11, 2021

(65) Prior Publication Data

US 2021/0302863 A1 Sep. 30, 2021

(30) Foreign Application Priority Data

Mar. 24, 2020 (JP) ..... JP2020-053134

(51) Int. Cl.
*G03G 15/04* (2006.01)
*G03G 21/16* (2006.01)
*G03G 21/10* (2006.01)

(52) U.S. Cl.
CPC . *G03G 15/04036* (2013.01); *G03G 15/04054* (2013.01); *G03G 21/105* (2013.01); *G03G 21/1666* (2013.01); *G03G 2221/1684* (2013.01)

(58) Field of Classification Search
CPC ..... G03G 15/04036; G03G 15/04054; G03G 15/04063; G03G 21/1633; G03G 21/1666; G03G 2221/1684
See application file for complete search history.

(56) References Cited

U.S. PATENT DOCUMENTS 5,185,630 A * 2/1993 Nagasawa ..... G03G 15/0258 399/100
9,298,158 B1 * 3/2016 Sono ..... G03G 21/1666
10,613,472 B2 * 4/2020 Ao ..... G03G 21/1647
2003/0053819 A1 3/2003 Nomura et al.
2007/0160382 A1 * 7/2007 Tomatsu ..... G03G 21/1619 399/107
2008/0247793 A1 10/2008 Sato et al.
2009/0169245 A1 7/2009 Sato
2009/0190953 A1 7/2009 Okabe
2009/0269101 A1 10/2009 Okabe et al.
2009/0324283 A1 * 12/2009 Mushika ..... G03G 21/1604 399/119

(Continued)

FOREIGN PATENT DOCUMENTS

JP 8-36346 A 2/1996
JP 2003-43776 A 2/2003

(Continued)

*Primary Examiner* — Carla J Therrien
(74) *Attorney, Agent, or Firm* — Merchant & Gould P.C.

(57) ABSTRACT

A housing includes a first side wall having a first opening and a second side wall arranged spaced away from the first side wall in a first direction. A drawer detachably supports a drum unit. The drawer moves through the first opening between an inside position at which the drawer is located inside the housing and an outside position at which the drawer is located outside the housing. An LED unit moves between: a first position at which the LED unit exposes the photosensitive drum; and a second position at which the LED unit is farther away from the photosensitive drum than at the first position and the LED unit is closer to the first side wall in the first direction than at the first position.

12 Claims, 9 Drawing Sheets

(56) References Cited

U.S. PATENT DOCUMENTS

| | | | | |
|---|---|---|---|---|
| 2012/0163857 | A1* | 6/2012 | Kamimura | G03G 21/1666 399/110 |
| 2012/0183323 | A1 | 7/2012 | Nakano et al. | |
| 2016/0119493 | A1* | 4/2016 | Sono | G03G 15/011 399/110 |
| 2016/0154375 | A1 | 6/2016 | Kamizato et al. | |
| 2016/0342106 | A1* | 11/2016 | Kono | G03G 21/1666 |
| 2017/0277115 | A1* | 9/2017 | Yamamura | G03G 21/1633 |

FOREIGN PATENT DOCUMENTS

| | | | |
|---|---|---|---|
| JP | 2008-250028 | A | 10/2008 |
| JP | 2009-9119 | A | 1/2009 |
| JP | 2009-175416 | A | 8/2009 |
| JP | 2009-265441 | A | 11/2009 |
| JP | 2009-265442 | A | 11/2009 |
| JP | 2010-256920 | A | 11/2010 |
| JP | 2010-271743 | A | 12/2010 |
| JP | 2012-22345 | A | 2/2012 |
| JP | 2012-145878 | A | 8/2012 |
| JP | 2014-16522 | A | 1/2014 |
| JP | 2016-102987 | A | 6/2016 |

* cited by examiner

IMAGE FORMING APPARATUS

CROSS REFERENCE TO RELATED APPLICATIONS

This application claims priority from Japanese Patent Application No. 2020-053134 filed Mar. 24, 2020. The entire content of the priority application is incorporated herein by reference.

TECHNICAL FIELD

This disclosure relates to an image forming apparatus.

BACKGROUND

Conventionally, the image forming apparatus includes a housing, a drawer, a drum unit, and a scanner unit. The drawer detachably supports the drum unit. The drawer moves between an inside position located inside the housing and an outside position located outside the housing. The drum unit has a photosensitive drum. The scanner unit exposes the photosensitive drum.

SUMMARY

According to one aspect, this specification discloses an image forming apparatus. The image forming apparatus includes a housing, a drum unit, a drawer, and an LED unit. The housing includes a first side wall having a first opening and a second side wall arranged spaced away from the first side wall in a first direction. The drum unit includes a photosensitive drum. The drawer is configured to detachably support the drum unit. The drawer is configured to move through the first opening between an inside position at which the drawer is located inside the housing and an outside position at which the drawer is located outside the housing. The LED unit is configured to move between: a first position at which the LED unit exposes the photosensitive drum; and a second position at which the LED unit is farther away from the photosensitive drum than at the first position and the LED unit is closer to the first side wall in the first direction than at the first position.

BRIEF DESCRIPTION OF THE DRAWINGS

Embodiments in accordance with this disclosure will be described in detail with reference to the following figures wherein.

DETAILED DESCRIPTION

In an image forming apparatus, it is considered to adopt an LED unit instead of the scanner unit. However, when the LED unit is adopted, the LED unit may get in the way when moving a drawer that supports the drum unit from the inside position to the outside position.

In view of the foregoing, an example of an object of this disclosure is to provide an image forming apparatus including a drawer and an LED unit, the image forming apparatus being configured to suppress the LED unit getting in the way of movement of the drawer.

1. Image Forming Apparatus 1

An image forming apparatus 1 will be described with reference to FIGS. 1 to 4.

Figure 1:
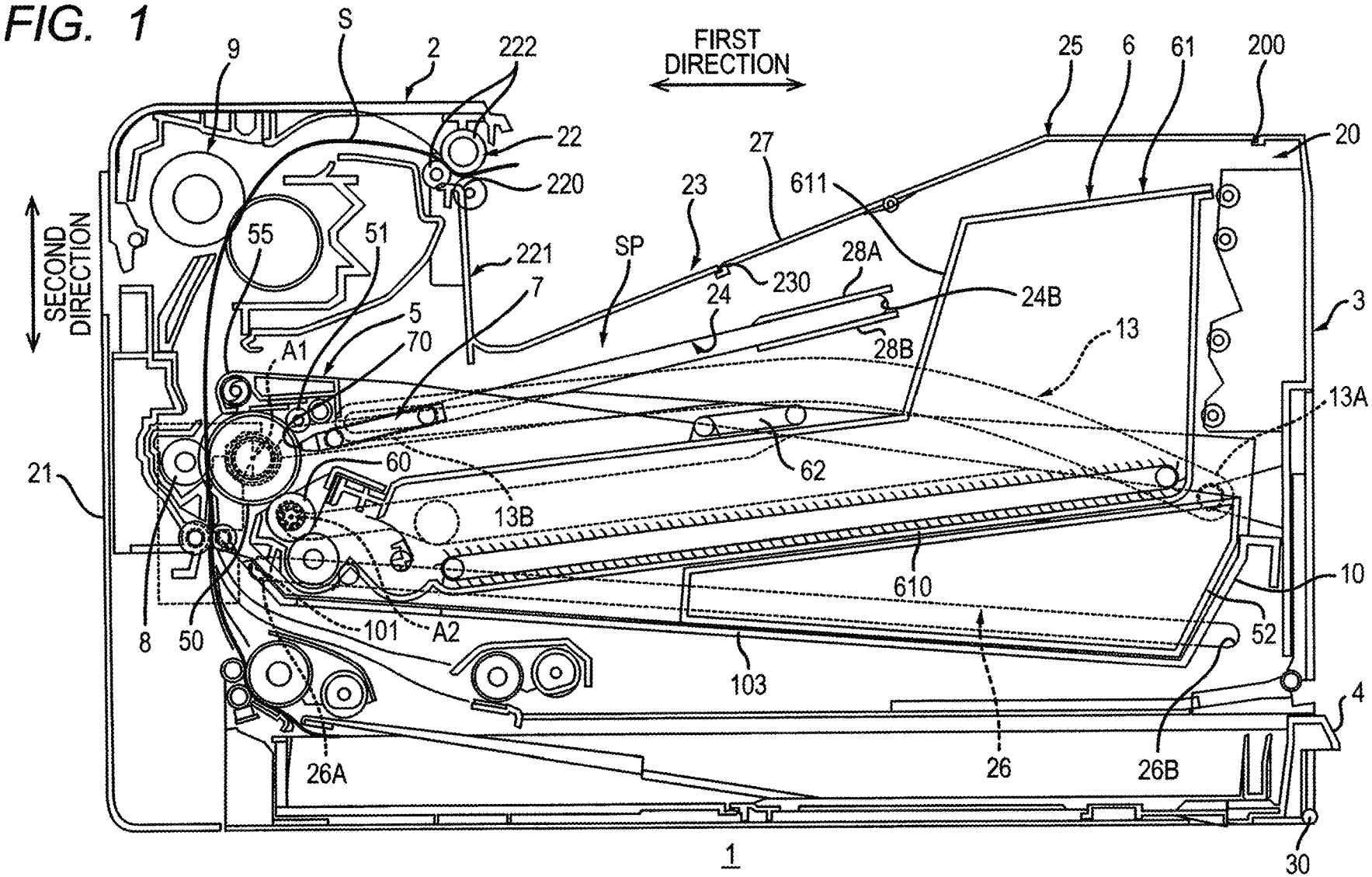
FIG. 1 is a cross-sectional view of an image forming apparatus of a first embodiment, showing a state where a first cover is located at a first closed position.

As shown in FIG. 1, the image forming apparatus 1 includes a housing 2, a first cover 3, a sheet cassette 4, a drawer 10, a drum unit 5, a development unit 6, an LED unit 7, a transfer roller 8, and a fixing device 9. The image forming apparatus 1 is an image forming apparatus dedicated to monochrome printing. Therefore, the image forming apparatus 1 includes one drum unit 5 and one development unit 6.

1.1 Housing 2

The housing 2 accommodates the sheet cassette 4, the drawer 10, the drum unit 5, the development unit 6, the LED unit 7, the transfer roller 8, and the fixing device 9. The housing 2 includes a first side wall 20, a second side wall 21, and an upper frame 25.

1.1.1 First Side Wall 20 and Second Side Wall 21

The first side wall 20 is located at one end of the housing 2 in a first direction. The second side wall 21 is located at the other end of the housing 2 in the first direction. The second side wall 21 is spaced away from the first side wall 20 in the first direction. The first side wall 20 extends in a second direction. The second side wall 21 extends in the second direction. The second direction is perpendicular to the first direction. Specifically, the second direction is the vertical direction. The first side wall 20 has a first opening 200.

1.1.2 Upper Frame 25

The upper frame 25 is located at one end of the housing 2 in the second direction. Specifically, the upper frame 25 constitutes the upper surface of the housing 2. The upper frame 25 is arranged above a toner storage portion 61 in a state where the development unit 6 arranged in the housing 2. The toner storage portion 61 will be described later. The upper frame 25 includes a discharge portion 22 and a discharge tray 23. In other words, the housing 2 includes the discharge portion 22 and the discharge tray 23.

1.1.2.1 Discharge Portion 22

The discharge portion 22 is located between the fixing device 9 and the first side wall 20 in the first direction. The discharge portion 22 includes a discharge wall 221 and a discharge roller 222. The discharge wall 221 extends in the second direction. The discharge wall 221 has a discharge opening 220. In other words, the discharge portion 22 has the discharge opening 220. The discharge roller 222 is located within the discharge opening 220. The discharge roller 222 conveys a sheet S that has passed through the fixing device 9 toward the discharge tray 23. With this operation, the sheet is discharged from the discharge opening 220.

1.1.2.2 Discharge Tray 23

The sheet discharged from the discharge opening 220 is placed on the discharge tray 23. The discharge tray 23 is located between the discharge wall 221 and the first side wall 20 in the first direction.

The discharge tray 23 extends in the first direction. The discharge tray 23 has one end and the other end in the first direction. The one end of the discharge tray 23 in the first direction is connected to the discharge wall 221. The other end of the discharge tray 23 in the first direction is connected to the first side wall 20.

The discharge tray 23 has a second opening 230. The second opening 230 is an opening for cleaning a light emitting surface 70 of the LED unit 7. The light emitting surface 70 will be described later. The second opening 230 is located away from the discharge wall 221 in the first direction.

1.2 First Cover 3

Figure 2:
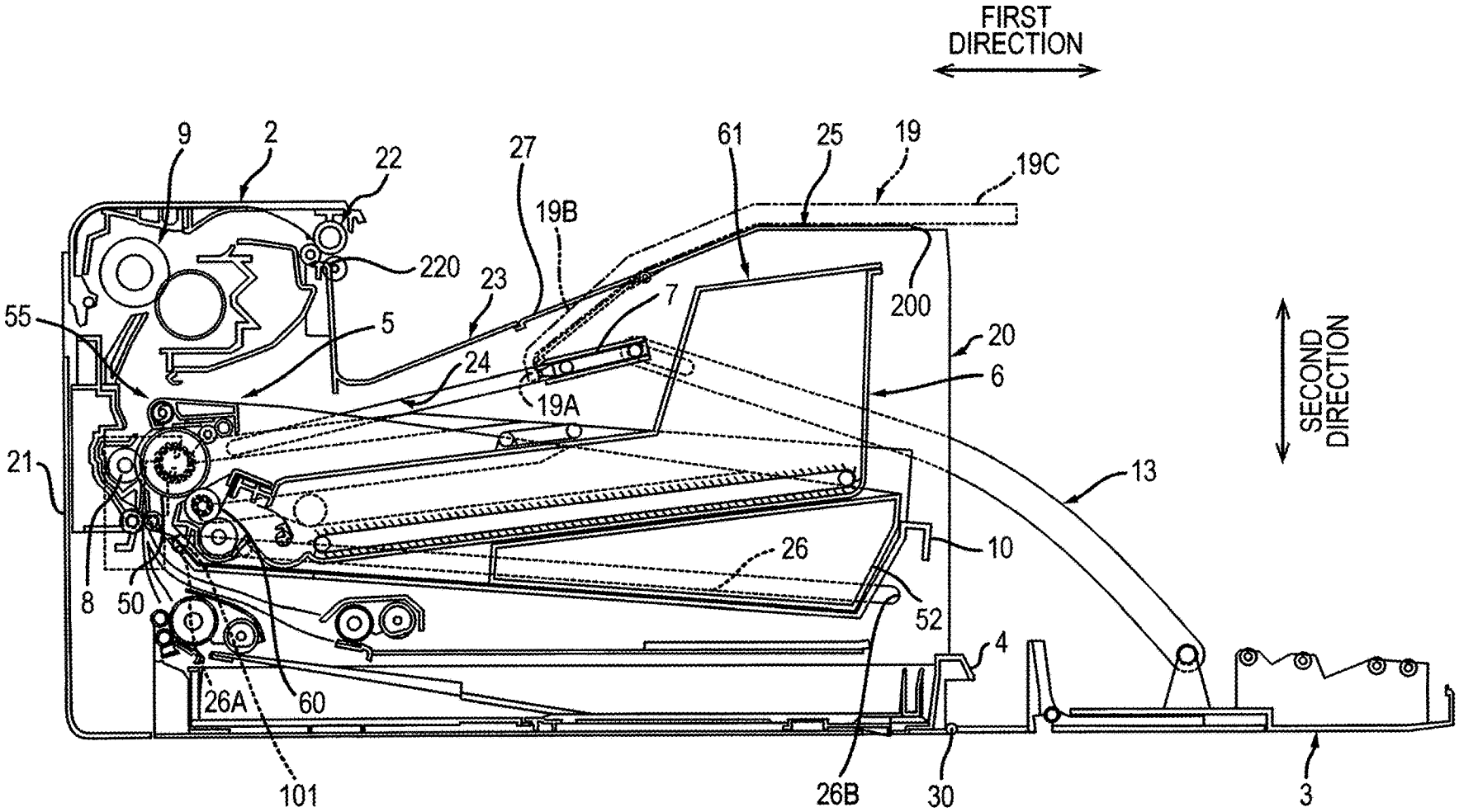
FIG. 2 shows the image forming apparatus shown in FIG. 1 in a state where the first cover is located at a first open position.

The first cover 3 is movable between a first closed position (see FIG. 1) and a first open position (see FIG. 2). In a state where the first cover 3 is located at the first closed position, the first cover 3 closes the first opening 200 (see FIG. 1). In a state where the first cover 3 is located at the first open position, the first opening 200 is open (see FIG. 2). The first cover 3 is rotatable about a first cover shaft 30 between the first closed position and the first open position. The first cover shaft 30 extends in a third direction. The third direction intersects the first direction and the second direction.

1.3 Sheet Cassette 4

The sheet cassette 4 accommodates the sheet S. The sheet S in the sheet cassette 4 is conveyed toward the transfer roller 8. The sheet cassette 4 is slidable relative to the housing 2 in the first direction. The sheet cassette 4 is arranged below the toner storage portion 61 in a state where the development unit 6 is arranged in the housing 2.

1.4 Drawer 10

Figure 3:
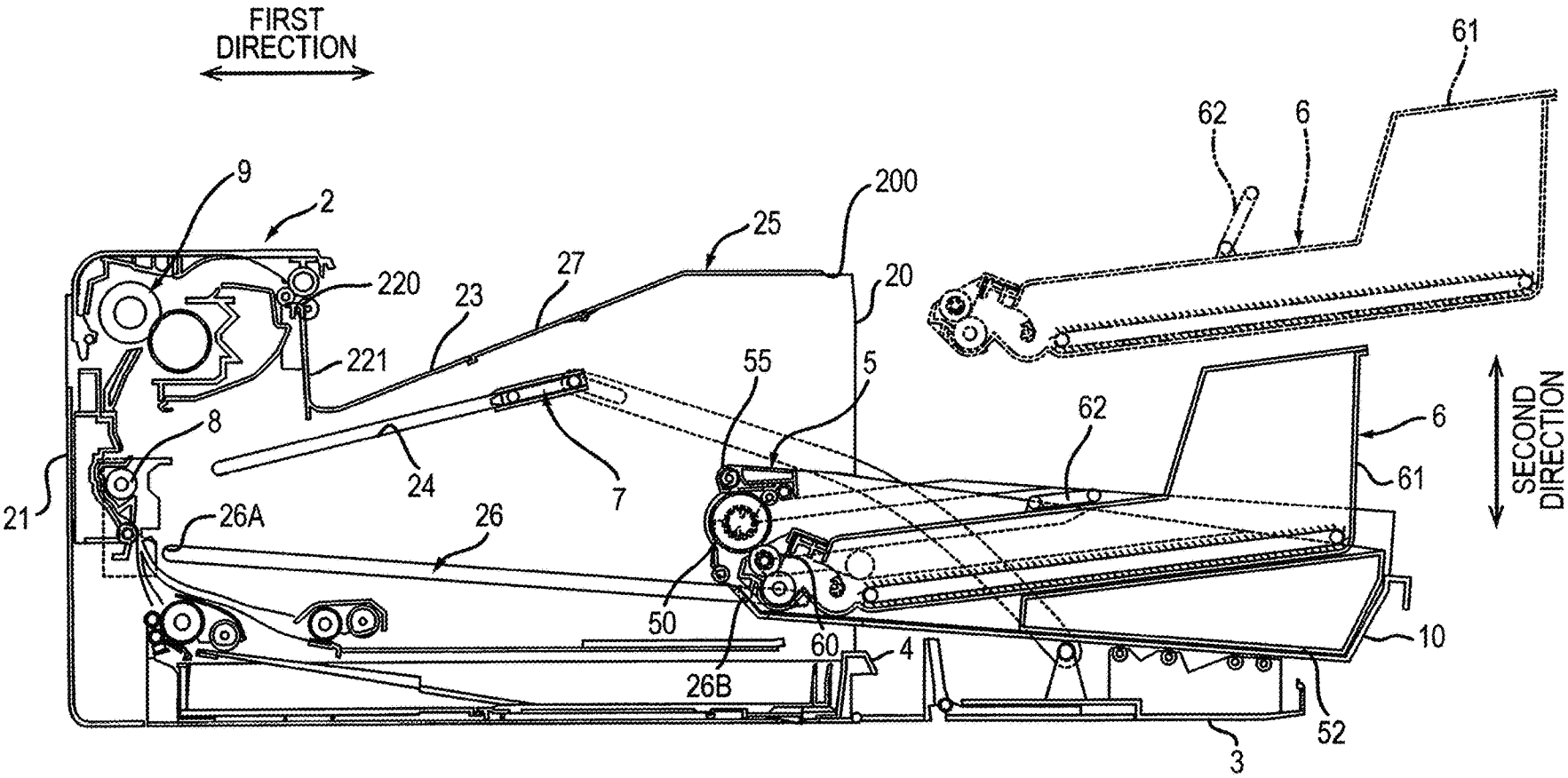
FIG. 3 shows the image forming apparatus shown in FIG. 1 in a state where a drawer is located at an outside position and a development unit is detached from a drum unit.
Figure 4:
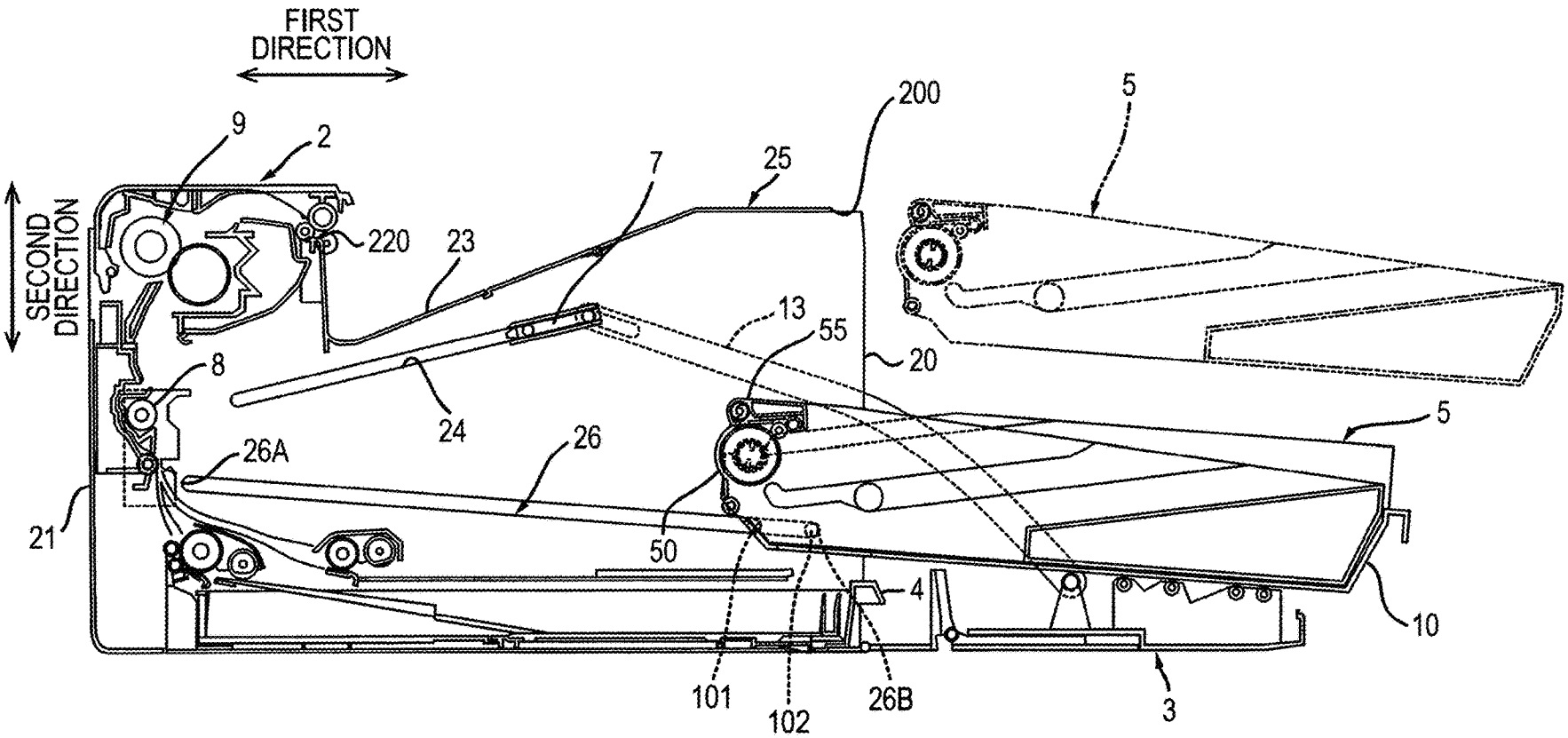
FIG. 4 shows the image forming apparatus shown in FIG. 1 in a state where the drawer is located at the outside position and the drum unit is detached from a drawer.

As shown in FIGS. 2 to 4, in a state where the first cover 3 is located at the first open position, the drawer 10 is configured to move through the first opening 200 between an inside position (see FIG. 2) and an outside position (see FIGS. 3 and 4) in the first direction. The drawer 10 detachably supports the drum unit 5 (see FIG. 4). In a state where the drawer 10 is located at the inside position, the entirety of the drawer 10 is located inside the housing 2 (see FIG. 2). In a state where the drawer 10 is located at the outside position, at least part of the drawer 10 is located outside the housing 2 (see FIGS. 3 and 4).

1.5 Drum Unit 5

In a state where the drum unit 5 is attached to the drawer 10, the drum unit 5 is movable with the drawer 10. In a state where the drum unit 5 is attached to the drawer 10 and the drawer 10 is located at the inside position, the drum unit 5 is located within the housing 2, and the drum unit 5 cannot be attached to or detached from the drawer 10 (see FIG. 2). In a state where the drum unit 5 is attached to the drawer 10 and the drawer 10 is located at the outside position, at least part of the drum unit 5 is located outside the housing 2, and the drum unit 5 can be attached to or detached from the drawer 10 (see FIG. 4). As shown in FIG. 1, the drum unit 5 includes a photosensitive drum 50 and a charging device 51.

1.5.1 Photosensitive Drum 50

The photosensitive drum 50 extends in the third direction. The photosensitive drum 50 has a cylindrical shape. The photosensitive drum 50 is rotatable about an axis A1. The axis A1 extends in the third direction.

1.5.2 Charging Device 51

The charging device 51 charges the circumferential surface of the photosensitive drum 50. In this embodiment, the charging device 51 is a charging roller. The charging device 51 contacts the circumferential surface of the photosensitive drum 50. The charging device 51 may be a scorotron type charger.

1.6 Development Unit 6

The development unit 6 is configured to supply toner to the photosensitive drum 50. The development unit 6 includes a development roller 60. The development unit 6 accommodates toner. In the present embodiment, the development unit 6 is detachably supported by the drum unit 5 (see FIG. 3). Thus, the drum unit 5 including the photosensitive drum 50 and the development unit 6 including the development roller 60 and storing the toner can be individually replaced.

In a state where the drum unit 5 is attached to the drawer 10 and the development unit 6 is attached to the drum unit 5, the development unit 6 is movable with the drawer 10.

In a state where the drum unit 5 is attached to the drawer 10 and the development unit 6 is attached to the drum unit 5 and the drawer 10 is located at the inside position, the drum unit 5 and the development unit 6 are located within the housing 2 and the development unit 6 cannot be attached to or detached from the drum unit 5 (see FIG. 2). In a state where the drum unit 5 and the development unit 6 are arranged in the housing 2, the development unit 6 is located between the transfer roller 8 and the first cover 3 in the first direction.

In a state where the drum unit 5 is attached to the drawer 10 and the development unit 6 is attached to the drum unit 5 and the drawer 10 is located at the outside position, at least part of the development unit 6 is located outside the housing 2 and the development unit 6 can be attached to or detached from the drum unit 5 (see FIG. 3).

Alternatively, the development unit 6 may be integrally formed with the drum unit 5.

1.6.1 Development Roller 60

The development roller 60 supplies toner to the photosensitive drum 50. In a state where the development unit 6 is attached to the drum unit 5, the development roller 60 is in contact with the photosensitive drum 50. The development roller 60 is rotatable about an axis A2. The axis A2 extends in the third direction.

1.7 LED Unit 7

The LED unit 7 is configured to move between a first position (see FIG. 1) and a second position (see FIG. 2). In a state where the drum unit 5 is attached to the drawer 10 and the drawer 10 is located at the inside position and the LED unit 7 is located at the first position, the LED unit 7 is configured to expose the photosensitive drum 50. The LED unit 7 has a light emitting surface 70. In a state where the drum unit 5 is attached to the drawer 10 and the drawer 10 is located at the inside position and the LED unit 7 is located at the first position, the LED unit 7 emits light from the light emitting surface 70 so that an image of the light is formed on the circumferential surface of photosensitive drum 50.

1.8 Transfer Roller 8

The transfer roller 8 transfers the toner on the circumferential surface of the photosensitive drum 50 to a sheet S. Specifically, the sheet S conveyed from the sheet cassette 4 toward the transfer roller 8 passes between the transfer roller 8 and the photosensitive drum 50 and is conveyed to the fixing device 9. At this time, the transfer roller 8 transfers the toner on the photosensitive drum 50 to the sheet S.

1.9 Fixing Device 9

The fixing device 9 heats and pressurizes the sheet S on which a toner image is transferred to fix the toner image on the sheet S. The sheet S having passed through the fixing device 9 is discharged to the discharge tray 23 through the discharge opening 220.

2. Detail of Housing 2

The housing 2 includes a drawer guide 26, a second cover 27, a guide 24, and two ribs 28A and 28B, in addition to the first side wall 20, the second side wall 21 and the upper frame 25 described above.

2.1 Drawer Guide 26

The drawer guide 26 guides the movement of the drawer 10. The drawer guide 26 is located within the housing 2. The drawer guide 26 is a groove. The drawer guide 26 may be a rib. The drawer guide 26 extends in the first direction.

The drawer guide 26 has one end 26A and an other end 26B located away from the one end 26A in the first direction. At the one end 26A, the drawer 10 located at the inside position is located. At the other end 26B, the drawer 10 located at the outside position is located. The one end 26A is located at the opposite side of the first cover 3 with respect to the other end 26B in the first direction. The drawer guide 26 inclines downward from the one end 26A toward the other end 26B. A first guided portion 101 and a second guided portion 102 of the drawer 10 are fitted in the drawer guide 26. The first guided portion 101 and the second guided portion 102 will be described later.

2.2 Second Cover 27

Figure 5A:
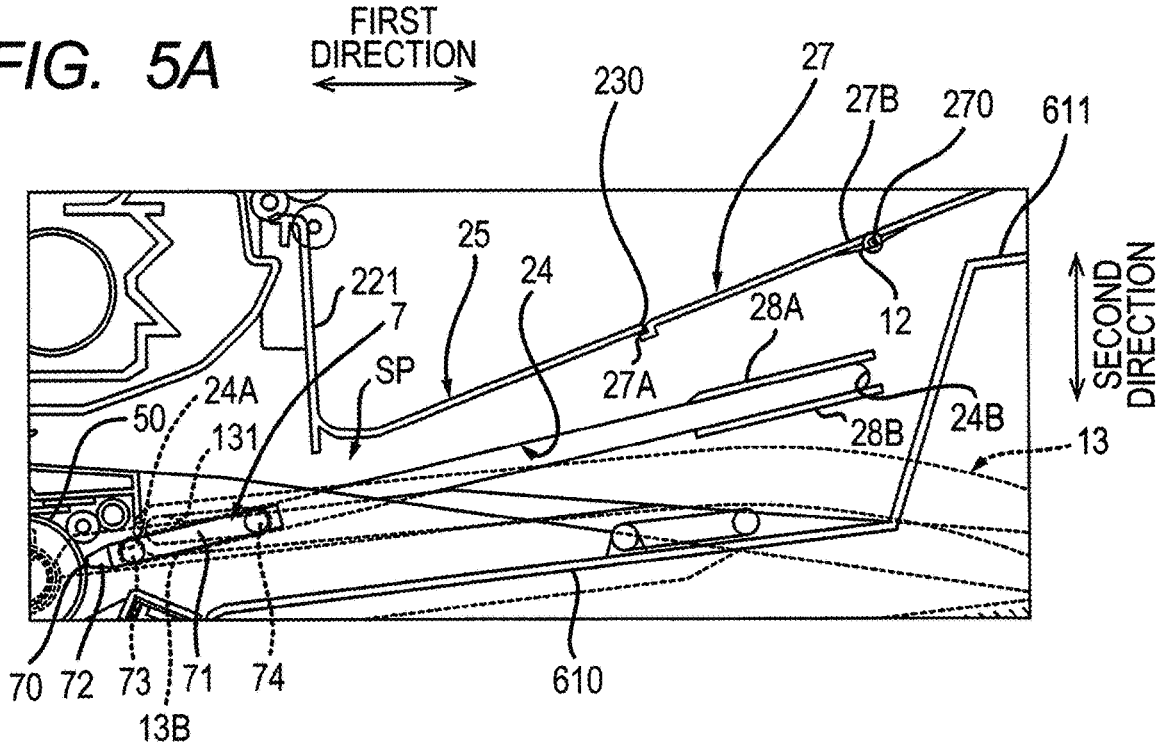
FIG. 5A is an enlarged view of an LED unit shown in FIG. 1, showing a state where the LED unit is located at a first position.
Figure 5B:
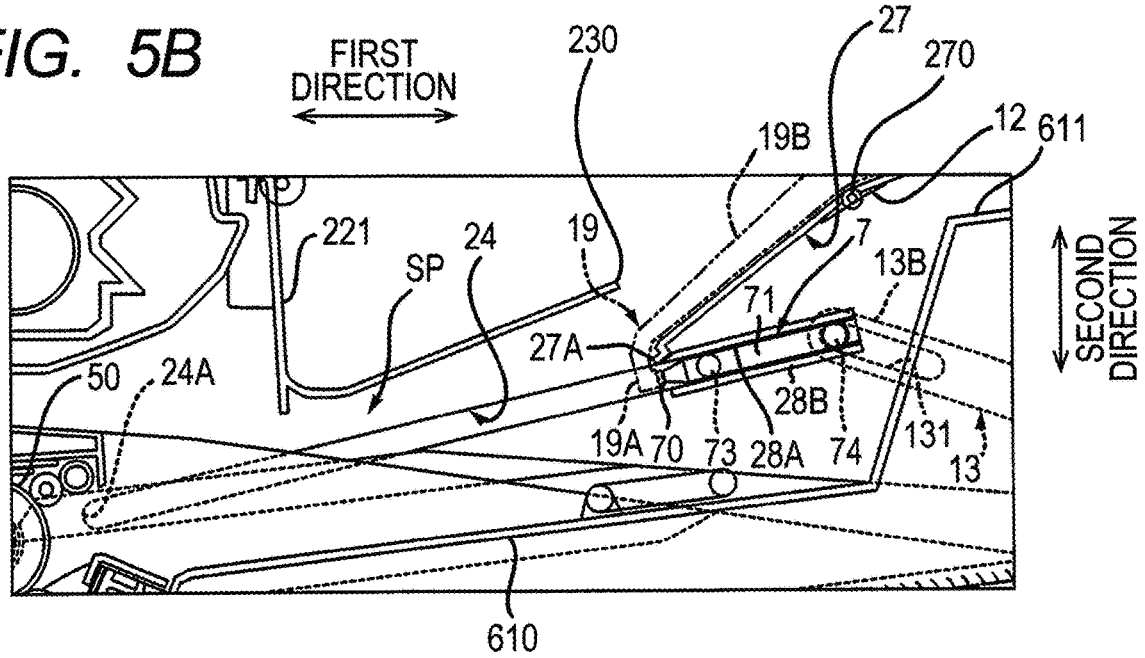
FIG. 5B is an enlarged view of the LED unit shown in FIG. 2, showing a state where the LED unit is located at a second position.

As shown in FIGS. 5A and 5B, the second cover 27 is movable between a second closed position (see FIG. 5A) and a second open position (see FIG. 5B). In a state where the second cover 27 is located at the second closed position, the second cover 27 closes the second opening 230 (see FIG. 5A). In a state where the second cover 27 is located at the second open position, the second opening 230 is open (see FIG. 5B). In a state where the second cover 27 is located at the second open position, the second cover 27 is located within the housing 2 (see FIG. 5B).

The second cover 27 is rotatably movable about a second cover shaft 270 between the second closed position (see FIG. 5A) and the second open position (see FIG. 5B). The second cover shaft 270 extends in the third direction. The second cover 27 extends in a direction that intersects the third direction. The second cover 27 has one end 27A and an other end 27B located away from the one end 27A in the first direction in a state where the second cover 27 is located at the second closed position. The one end 27A is located at the opposite side of the first cover 3 (see FIG. 1) with respect to the other end 27B in the first direction. The one end 27A is located within the housing 2 in a state where the second cover 27 is located at the second open position (see FIG. 5B). The other end 27B is connected to the discharge tray 23. The other end 27B has the second cover shaft 270.

The second cover 27 is maintained at the second closed position by a spring 12. The image forming apparatus 1 further includes the spring 12. The spring 12 pushes the second cover 27 toward the second closed position. The second cover 27 is movable from the second closed position to the second open position against the force of the spring 12 (see FIG. 5B). The second cover 27 moves from the second open position to the second closed position by the force of the spring 12 (see FIG. 5A).

2.3 Guide 24

The guide 24 guides the movement of the LED unit 7. The guide 24 is located within the housing 2. The guide 24 is located between the drawer guide 26 (see FIG. 1) and the upper frame 25 in the second direction. The guide 24 is a groove. The guide 24 may be a rib. The guide 24 extends in the first direction.

The guide 24 has a first end 24A and a second end 24B. At the first end 24A, the LED unit 7 located at the first position is located (see FIG. 5A). At the second end 24B, the LED unit 7 located at the second position is located (see FIG. 5B). The first end 24A is located at the opposite side of the first cover 3 (see FIG. 1) with respect to the second end 24B in the first direction. The first end 24A is located between the discharge wall 221 and the second side wall 21 (see FIG. 1) in the first direction. The second end 24B is located away from the first end 24A in the first direction. The second end 24B is located at the opposite side of the first end 24A with respect to the discharge wall 221 in the first direction. In a state where the second cover 27 is located at the second closed position, the second end 24B is located between the one end 27A and the other end 27B of the second cover 27 in the first direction. The guide 24 is inclined upward from the first end 24A toward the second end 24B. The guide 24 gets closer to the second opening 230 from the first end 24A toward the second end 24B. A first boss 73 and a second boss 74 of the LED unit 7 are fitted in the guide 24. The first boss 73 and the second boss 74 will be described later.

2.4 Ribs 28A, 28B

The two ribs 28A and 28B support the LED unit 7 in a state where the LED unit 7 is located at the second position. The two ribs 28A and 28B are located within the housing 2. The two ribs 28A and 28B are located away from the second cover 27 in the second direction. The two ribs 28A and 28B extend in the same direction as the guide 24. The two ribs 28A and 28B are spaced from each other in a direction perpendicular to the extending direction of the guide 24. The second end 24B of the guide 24 is located between the two ribs 28A and 28B.

3. Detail of Drawer 10

As shown in FIGS. 2 and 3, the drawer 10 moves downward by the inclination of the drawer guide 26 as the drawer 10 moves from the inside position toward the outside position. This makes the drawer 10 easily movable from the inside position toward the outside position by utilizing the weight of the drawer 10. The drawer 10 moves downward to separate from the LED unit 7 when the drawer 10 moves from the inside position toward the outside position. This stably reduces a likelihood that the LED unit 7 will interfere with the movement of the drawer 10 from the inside position toward the outside position in a state where the LED unit 7 is located at the second position.

Figure 6:
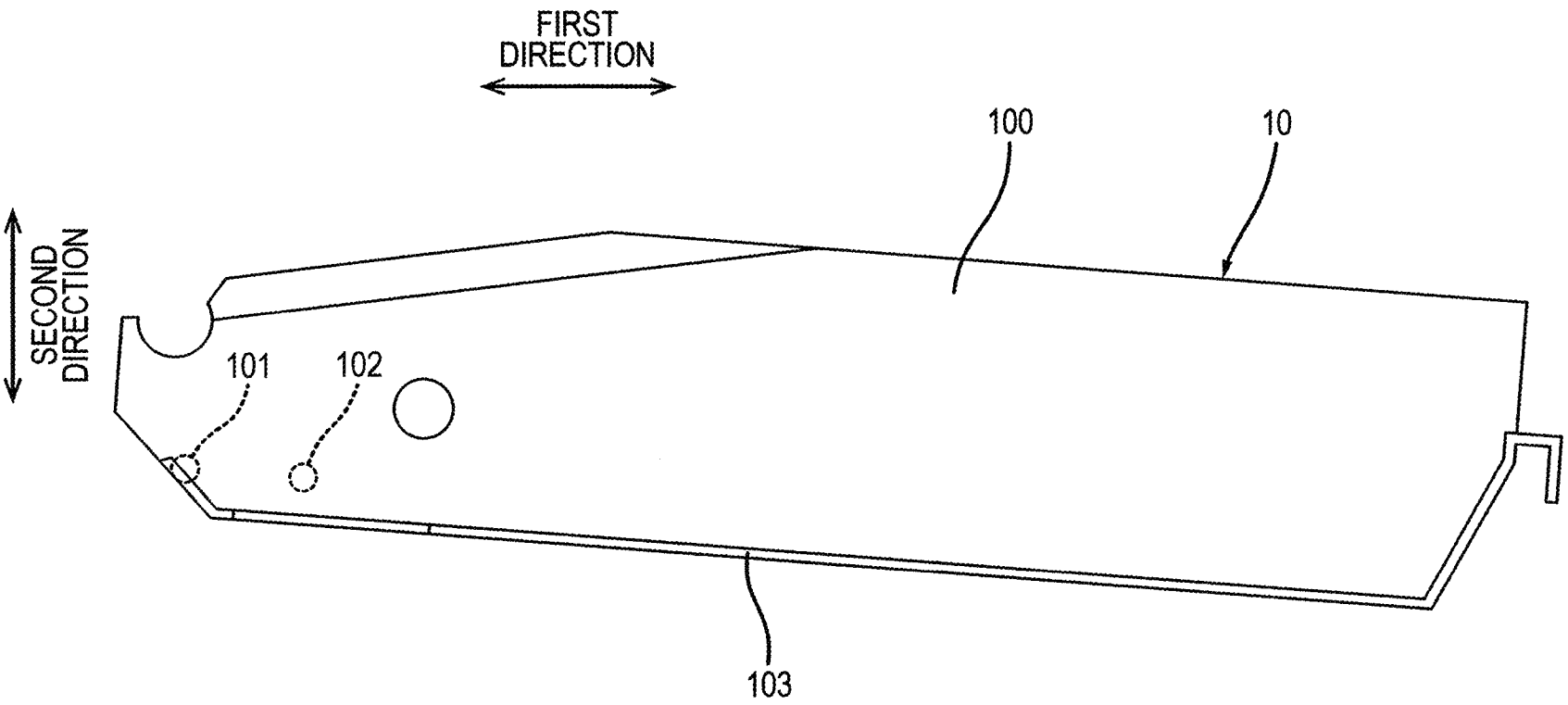
FIG. 6 is a cross-sectional view of the drawer shown in FIG. 1.

As shown in FIG. 6, the drawer 10 has a shape like a tray. The drawer 10 extends in the first direction and the third direction. The drawer 10 includes a first drawer side plate 100, a second drawer side plate (not shown), the first guided portion 101, the second guided portion 102, and a bottom plate 103.

3.1 First Drawer Side Plate 100 and Second Drawer Side Plate

The first drawer side plate 100 is located at one end of the drawer 10 in the third direction. The first drawer side plate 100 extends in the first direction. The second drawer side plate (not shown) is located at the other end of the drawer 10 in the third direction. The second drawer side plate (not shown) is located away from the first drawer side plate 100 in the third direction.

3.2 First Guided Portion 101

The first guided portion 101 is located at the opposite side of the second drawer side plate (not shown) with respect to the first drawer side plate 100 in the third direction. The first guided portion 101 is a protrusion. The first guided portion 101 has a circular columnar shape. The first guided portion 101 extends in the third direction from the first drawer side plate 100. The first guided portion 101 may be attached to the first drawer side plate 100. The first guided portion 101 is fitted in the drawer guide 26 (see FIG. 1). The first guided portion 101 is guided along the drawer guide 26. In a state where the drawer 10 is located at the inside position, the first guided portion 101 is fitted to the one end 26A of the drawer guide 26 (see FIG. 1).

3.3 Second Guided Portion 102

The second guided portion 102 is located at the opposite side of the second drawer side plate (not shown) with respect to the first drawer side plate 100 in the third direction. The second guided portion 102 is located away from the first guided portion 101 in the first direction. The second guided portion 102 is located at the opposite side of the second side wall 21 (see FIG. 1) with respect to the first guided portion 101 in the first direction. The second guided portion 102 is a protrusion. The second guided portion 102 has a circular columnar shape. The second guided portion 102 extends in the third direction from the first drawer side plate 100. The second guided portion 102 may be attached to the first drawer side plate 100. The second guided portion 102 is fitted in the drawer guide 26 (see FIG. 4). The second guided portion 102 is guided along the drawer guide 26. In a state where the drawer 10 is located at the outside position, the second guided portion 102 is fitted to the other end 26B of the drawer guide 26 (see FIG. 4).

3.4 Bottom Plate 103

The bottom plate 103 is located between the first drawer side plate 100 and the second drawer side plate (not shown) in the third direction. The bottom plate 103 extends in the third direction. The bottom plate 103 is connected to the first drawer side plate 100 and the second drawer side plate (not shown).

4. Detail of Drum Unit 5

Figure 7:
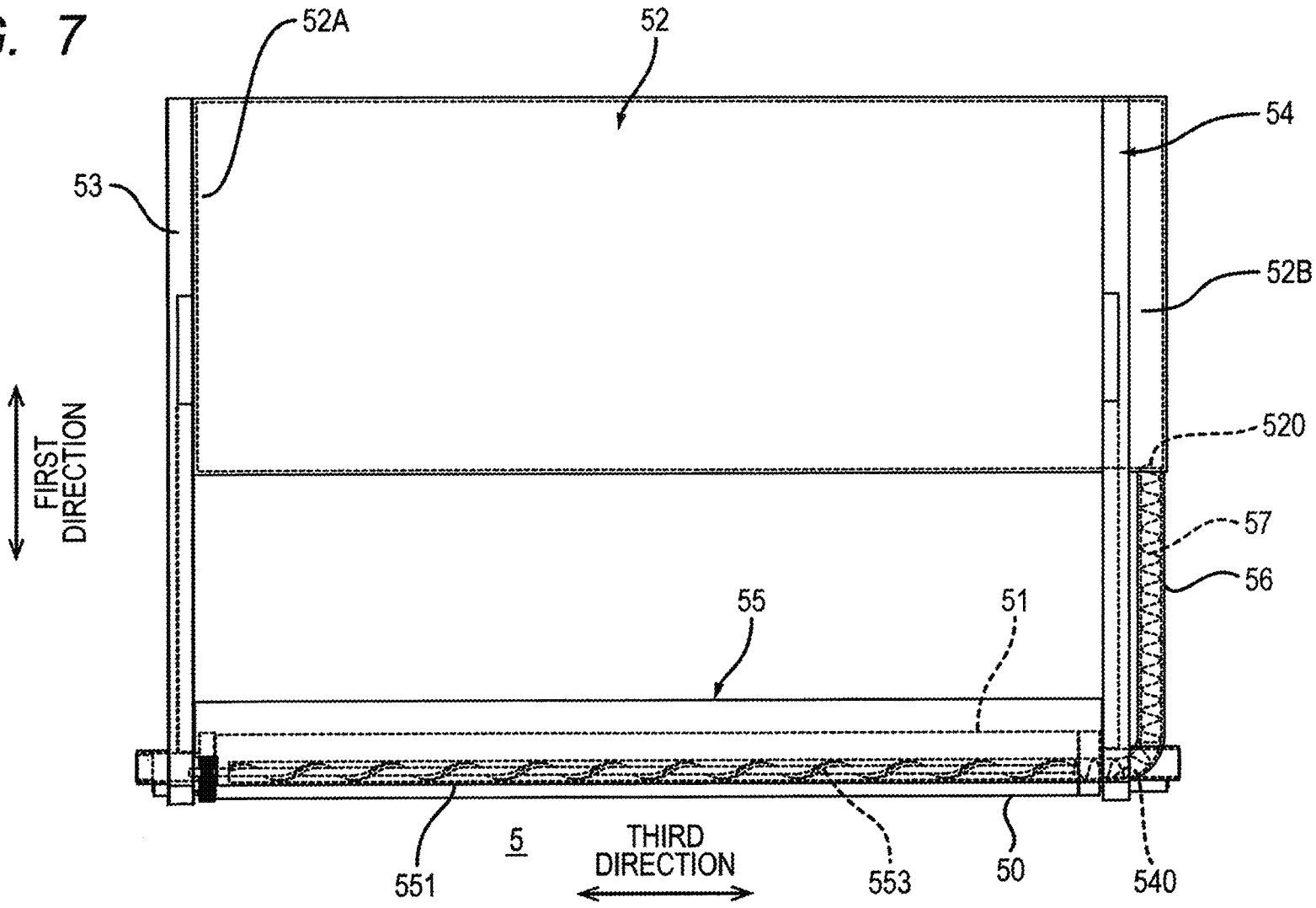
FIG. 7 is a plan view of the drum unit shown in FIG. 1.
Figure 8:
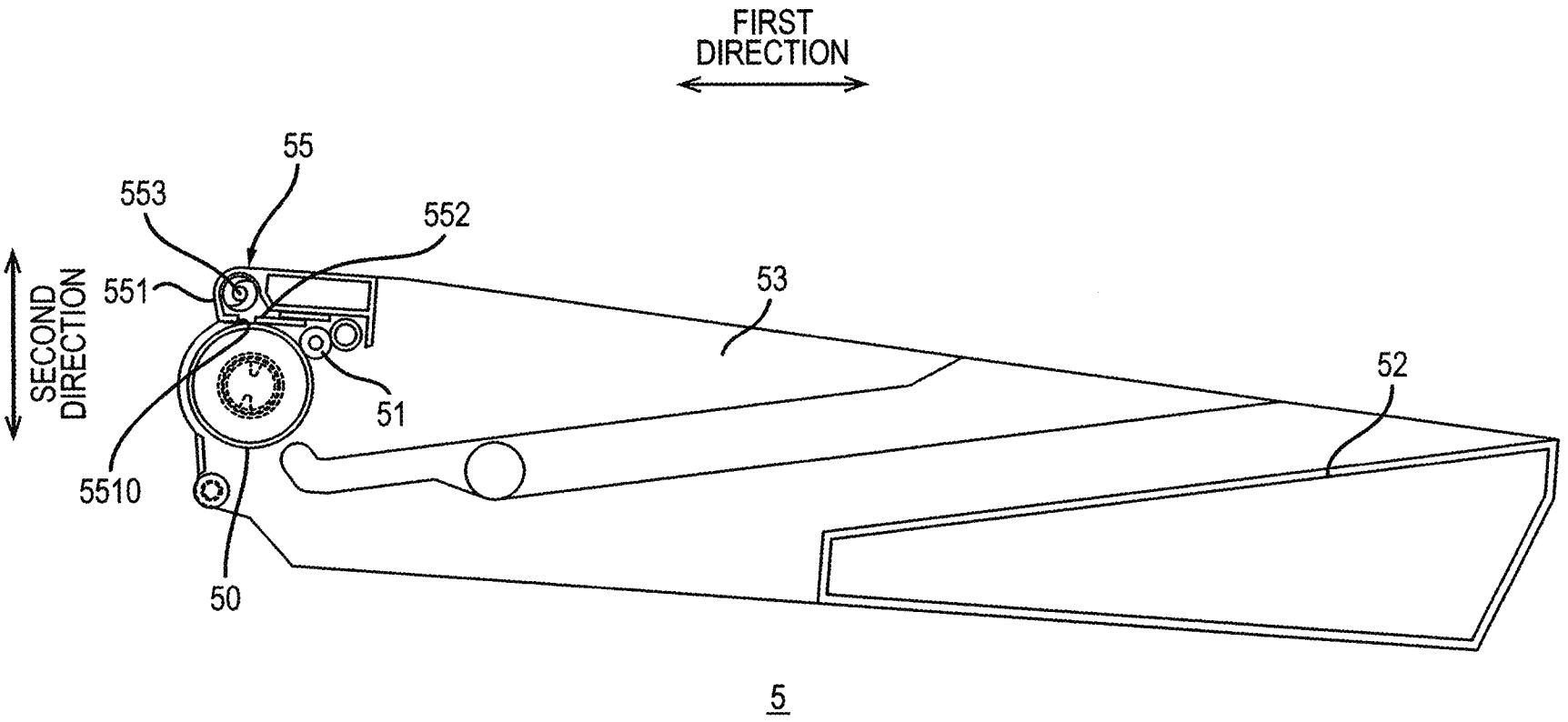
FIG. 8 is a cross-sectional view of the drum unit shown in FIG. 7.
Figure 9:
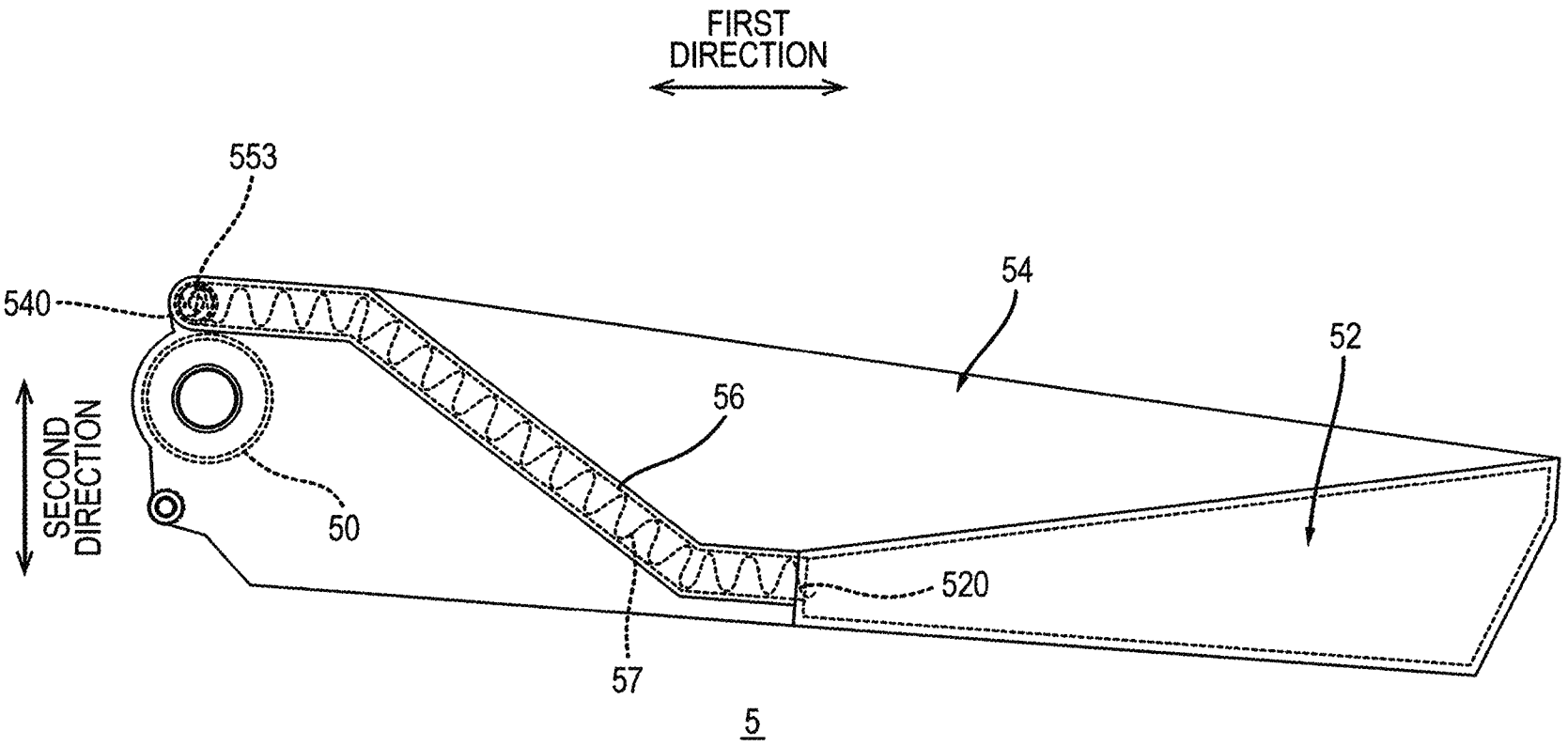
FIG. 9 is a side view of the drum unit shown in FIG. 7.

As shown in FIGS. 7 to 9, the drum unit 5 includes a first side plate 53, a second side plate 54, a drum cleaner 55, a waste toner storage portion 52, a waste toner conveyance pipe 56, and a screw 57, in addition to the photosensitive drum 50 and the charging device 51 described above. In other words, the image forming apparatus 1 includes the waste toner storage portion 52.

4.1 First Side Plate 53 and Second Side Plate 54

As shown in FIG. 7, the first side plate 53 is located at one end of the drum unit 5 in the third direction. The first side plate 53 extends in the first direction. The first side plate 53 has one end and the other end located away from the one end in the first direction. The one end of the first side plate 53 in the first direction supports one end of the photosensitive drum 50 in the third direction.

The second side plate 54 is located at the other end of the drum unit 5 in the third direction. The second side plate 54 is located away from the first side plate 53 in the third direction. In a state where the development unit 6 is attached to the drum unit 5, the second side plate 54 is located at the opposite side of the first side plate 53 with respect to the development unit 6 (see FIG. 1). The second side plate 54 extends in the first direction. The second side plate 54 has one end and the other end located away from the one end in the first direction. The one end of the second side plate 54 in the first direction supports the other end of the photosensitive drum 50 in the third direction. The one end of the second side plate 54 in the first direction has a first hole 540. In a state where the development unit 6 is attached to the drum unit 5, the first hole 540 is located at the opposite side of the development roller 60 with respect to the photosensitive drum 50 (see FIG. 1).

4.2 Drum Cleaner 55

The drum cleaner 55 is located between the first side plate 53 and the second side plate 54 in the third direction. In a state where the development unit 6 is attached to the drum unit 5, the drum cleaner 55 is located at the opposite side of the development roller 60 with respect to the photosensitive drum 50 (see FIG. 1). The drum cleaner 55 collects waste toner remaining on the surface of the photosensitive drum 50 without having been transferred to the sheet S (see FIG. 1).

As shown in FIGS. 7 and 8, the drum cleaner 55 includes a cleaner housing 551, a cleaning blade 552, and an auger screw 553.

4.2.1 Cleaner Housing 551

The cleaner housing 551 is located between the first side plate 53 and the second side plate 54 in the third direction. The cleaner housing 551 has a hollow shape. The cleaner housing 551 extends in the third direction. The cleaner housing 551 has one end and the other end located away from the one end in the third direction. The one end of the cleaner housing 551 in the third direction is connected to the first side plate 53. The other end of the cleaner housing 551 in the third direction is connected to the second side plate 54. The internal space of the cleaner housing 551 communicates with the first hole 540. As shown in FIG. 8, the cleaner housing 551 has an opening 5510.

4.2.2 Cleaning Blade 552

The cleaning blade 552 is supported by the cleaner housing 551. The cleaning blade 552 has an edge contacting the surface of the photosensitive drum 50. When the photosensitive drum 50 rotates, the waste toner on the surface of the photosensitive drum 50 contacts the edge of the cleaning blade 552 to be removed from the surface of the photosensitive drum 50. The removed waste toner passes through the opening 5510 to be stored in the cleaner housing 551.

4.2.3 Auger Screw 553

The auger screw 553 is located in the cleaner housing 551. The auger screw 553 extends in the third direction. The auger screw 553 conveys the waste toner in the cleaner housing 551 toward the waste toner conveyance pipe 56 (see FIG. 7).

4.3 Waste Toner Storage Portion 52

The waste toner storage portion 52 stores the waste toner having been removed from the photosensitive drum 50. The waste toner storage portion 52 is located away from the photosensitive drum 50 in the first direction. In a state where the drum unit 5 and the development unit 6 are arranged in the housing 2, the waste toner storage portion 52 is located below the development unit 6 (see FIG. 1). Thus, in a state where the drum unit 5 and the development unit 6 are arranged in the housing 2, the waste toner having been removed from the photosensitive drum 50 is conveyed smoothly due to gravity into the waste toner storage portion 52.

As shown in FIG. 7, the waste toner storage portion 52 is supported by the first side plate 53 and the second side plate 54. The waste toner storage portion 52 extends in the third direction. The waste toner storage portion 52 has one end 52A and an other end 52B located away from the one end 52A in the third direction. The one end 52A is connected to the first side plate 53. The other end 52B is located at the opposite side of the first side plate 53 with respect to the second side plate 54 in the third direction. The other end 52B has a second hole 520. The second hole 520 communicates with the internal space of the waste toner storage portion 52.

4.4 Waste Toner Conveyance Pipe 56

The waste toner conveyance pipe 56 is used for conveying the waste toner from the drum cleaner 55 to the waste toner storage portion 52. More specifically, the waste toner conveyance pipe 56 is used for conveying the waste toner from the first hole 540 communicating with the internal space of the cleaner housing 551 to the second hole 520 communicating with the internal space of the waste toner storage portion 52 (see FIG. 8).

The waste toner conveyance pipe 56 is located at the opposite side of the first side plate 53 with respect to the second side plate 54 in the third direction. The waste toner conveyance pipe 56 has one end and the other end located away from the one end. The one end of the waste toner conveyance pipe 56 is connected to the second side plate 54. The internal space of the waste toner conveyance pipe 56 at the one end communicates with the first hole 540. Thus, the waste toner in the cleaner housing 551 passes through the first hole 540 to be discharged into the waste toner conveyance pipe 56. The other end of the waste toner conveyance pipe 56 is connected to the other end 52B of the waste toner storage portion 52. The internal space of the waste toner conveyance pipe 56 at the other end communicates with the second hole 520. Thus, the waste toner in the waste toner conveyance pipe 56 passes through the second hole 520 to be discharged into the waste toner storage portion 52 (see FIG. 8).

4.5 Screw 57

The screw 57 is located in the waste toner conveyance pipe 56. The screw 57 conveys the waste toner in the waste toner conveyance pipe 56 toward the second hole 520. The screw 57 extends in the same direction as the waste toner conveyance pipe 56. The screw 57 is connected to the auger screw 553. The screw 57 is rotatable together with the auger screw 553. Specifically, the screw 57 is a shaftless screw.

5. Detail of Development Unit 6

As shown in FIG. 1, the development unit 6 includes the toner storage portion 61 and a grip 62, in addition to the development roller 60 described above.

5.1 Toner Storage Portion 61

The toner storage portion 61 stores toner. In a state where the drum unit 5 and the development unit 6 are arranged in the housing 2, the toner storage portion 61 is located between the photosensitive drum 50 and the first cover 3 in the first direction. In a state where the drum unit 5 and the development unit 6 are arranged in the housing 2, the toner storage portion 61 is located at the opposite side of the bottom plate 103 with respect to the waste toner storage portion 52. The toner storage portion 61 includes a first toner storage portion 610 and a second toner storage portion 611. The internal space of the first toner storage portion 610 and the internal space of the second toner storage portion 611 communicate with each other. This configuration increases the capacity of the toner storage portion 61.

In a state where the drum unit 5 and the development unit 6 are arranged in the housing 2, the first toner storage portion 610 extends in the first direction. In a state where the development unit 6 is attached to the drum unit 5, the first toner storage portion 610 is in contact with the waste toner storage portion 52.

In a state where the development unit 6 is attached to the drum unit 5, the second toner storage portion 611 is located at the opposite side of the waste toner storage portion 52 with respect to the first toner storage portion 610. In a state where the drum unit 5 and the development unit 6 are arranged in the housing 2, the second toner storage portion 611 extends in the vertical direction from the first toner storage portion 610. In a state where the drum unit 5 and the development unit 6 are arranged in the housing 2, the second toner storage portion 611 is located at the opposite side of the photosensitive drum 50 with respect to the guide 24. In a state where the drum unit 5 and the development unit 6 are arranged in the housing 2 and the first cover 3 is located at the first closed position, at least part of the toner storage portion 61 is located between the first cover 3 and the second end 24B. More specifically, in a state where the drum unit 5 and the development unit 6 are arranged in the housing 2 and the first cover 3 is located at the first closed position, the second toner storage portion 611 is located between the first cover 3 and the second end 24B. Thus, in a state where the first cover 3 is located at the first closed position, the LED unit 7 is movable between the first position and the second position at the opposite side of the first cover 3 with respect to the second toner storage portion 611. As a result, while the capacity of the toner storage portion 61 is increased, a space SP necessary for the movement of the LED unit 7 is ensured.

In a state where the drum unit 5 and the development unit 6 are arranged in the housing 2, the first toner storage portion 610, the second toner storage portion 611, the upper frame 25, and the photosensitive drum 50 define the space SP. In other words, the space SP is surrounded by the first toner storage portion 610, the second toner storage portion 611, and the upper frame 25.

5.2 Grip 62

The grip 62 is supported by the first toner storage portion 610. In a state where the development unit 6 is attached to the drum unit 5, the grip 62 is located between the photosensitive drum 50 and the second toner storage portion 611. In a state where the drum unit 5 and the development unit 6 are arranged in the housing 2, the grip 62 is located in the space SP. In a state where the drum unit 5 is attached to the drawer 10 and the development unit 6 is attached to the drum unit 5 and the drawer 10 is located at the outside position, the grip 62 is located outside the housing 2 and is held by a user (see FIG. 3). This allows the development unit 6 to be smoothly attachable to and detachable from the drum unit 5 (see FIG. 3)

6. Detail of LED Unit 7

As shown in FIGS. 5A and 5B, the LED unit 7 includes a frame 71, an LED print head 72, the first boss 73, and the second boss 74.

6.1 Frame 71 and LED Print Head 72

The frame 71 supports the LED print head 72. The frame 71 has one end supporting the LED print head 72, and the other end located away from the one end.

While not shown in the drawings, the LED print head 72 includes an LED array having a plurality of LEDs, and a lens array having a plurality of lenses. The LED print head 72 includes the light emitting surface 70 described above.

6.2 First Boss 73 and Second Boss 74

The first boss 73 and the second boss 74 are fitted in the guide 24. The first boss 73 and the second boss 74 are located at one end of the frame 71 in the third direction. The first boss 73 extends in the third direction from the frame 71. The first boss 73 has a circular columnar shape. The second boss 74 is located away from the first boss 73 in the direction in which the frame 71 extends. The second boss 74 is located at the opposite side of the LED print head 72 with respect to the first boss 73 in the direction in which the frame 71 extends. The second boss 74 extends in the third direction from the frame 71. The second boss 74 has a circular columnar shape.

6.3 First Position and Second Position of LED Unit 7

In a state where the drum unit 5 and the development unit 6 are arranged in the housing 2, the LED unit 7 is movable between the first position and the second position in the space SP. The LED unit 7 moves upward by the inclination of the guide 24 as the LED unit 7 moves from the first position toward the second position. Thus, the LED unit 7 separates upward from the drawer 10 when the LED unit 7 moves from the first position toward the second position. This reliably suppresses a situation that the LED unit 7 will contact the drum unit 5 and the development unit 6 when the drawer 10 moves between the inside position and the outside position in a state where the LED unit 7 is located at the second position.

As shown in FIG. 5A, in a state where the LED unit 7 is located at the first position, the LED print head 72 is located between the frame 71 and the photosensitive drum 50. In a state where the LED unit 7 is located at the first position, the light emitting surface 70 faces the photosensitive drum 50. In a state where the LED unit 7 is located at the first position, the LED unit 7 is located between the second side wall 21 and the discharge wall 221 in the first direction. In a state where the LED unit 7 is located at the first position, the LED unit 7 is located between the photosensitive drum 50 and the discharge wall 221 in the first direction. In a state where the LED unit 7 is located at the first position, the first boss 73 is fitted to the first end 24A of the guide 24.

As shown in FIG. 5B, in a state where the LED unit 7 is located at the second position, the LED unit 7 is farther away from the photosensitive drum 50 than the LED unit 7 located at the first position. In a state where the LED unit 7 is located at the second position, the LED unit 7 is closer to the first side wall 20 (see FIG. 1) in the first direction than the LED unit 7 located at the first position. In a state where the LED unit 7 is located at the second position, the LED unit 7 is located between the discharge wall 221 and the first side wall 20 in the first direction. In a state where the LED unit 7 is located at the second position, the LED unit 7 is located between the discharge wall 221 and the second toner storage portion 611 in the first direction. In a state where the LED unit 7 is located at the second position, the LED unit 7 overlaps the second toner storage portion 611 in the first direction and overlaps the second cover 27 in the vertical direction. In a state where the LED unit 7 is located at the second position, the second boss 74 is fitted to the second end 24B of the guide 24. In a state where the LED unit 7 is located at the second position, the frame 71 is located between the two ribs 28A and 28B.

As the LED unit 7 moves from the first position toward the second position, the LED unit 7 moves closer to the second opening 230. Thus, by locating the LED unit 7 at the second position, the light emitting surface 70 of the LED unit 7 can be cleaned smoothly through the second opening 230.

In a state where the LED unit 7 is located at the second position and the second cover 27 is located at the second open position, the light emitting surface 70 of the LED unit 7 and the one end 27A of the second cover 27 are aligned in the second direction.

The light emitting surface 70 is cleaned with a cleaning member 19 through the second opening 230.

The cleaning member 19 has a first part 19A, a second part 19B, and a third part 19C (see FIG. 2). The first part 19A and the second part 19B enter inside the housing 2 through the second opening 230. The first part 19A contacts the one end 27A of the second cover 27 and the light emitting surface 70 of the LED unit 7 from the opposite side of the first side wall 20 in the first direction. The second part 19B is located between the first part 19A and the third part 19C. The second part 19B is located at the opposite side of the LED unit 7 with respect to the second cover 27 in the second direction. The third part 19C is located outside the housing 2 and is held by a user.

The cleaning member 19 moves while the first part 19A is in contact with the one end 27A and the light emitting surface 70. With this operation, the light emitting surface 70 is cleaned.

7. Detail of Image Forming Apparatus 1

As shown in FIG. 1, the image forming apparatus 1 further includes a link member 13.

The link member 13 links the movement of the LED unit 7 with the movement of the first cover 3. In a state where the first cover 3 is located at the first closed position, the LED unit 7 is located at the first position (see FIG. 1). In a state where the first cover 3 is located at the first open position, the LED unit 7 is located at the second position (see FIG. 2).

7.1 Link Member 13

As shown in FIG. 1, the link member 13 links the LED unit 7 with the first cover 3. In a state where the first cover 3 is located at the first closed position, the link member 13 is located in the housing 2. The link member 13 has one end 13A and an other end 13B located away from the one end 13A.

The one end 13A of the link member 13 is rotatably connected to the first cover 3. As shown in FIGS. 5A and 5B, the other end 13B of the link member 13 is rotatably connected to the frame 71. The other end 13B of the link member 13 has an elongated hole 131. The elongated hole 131 is formed to penetrate the other end 13B of the link member 13 in the third direction. In a state where the first cover 3 is located at the first closed position, the elongated hole 131 extends in the first direction. The elongated hole 131 has one end and the other end located away from the one end. The second boss 74 is fitted in the elongated hole 131 with play. In a state where the first cover 3 is located at the first closed position and the LED unit 7 is located at the first position, the second boss 74 is located at the one end of the elongated hole 131 (see FIG. 5A). In a state where the first cover 3 is located at the first open position and the LED unit 7 is located at the second position, the second boss 74 is located at the other end of the elongated hole 131 (see FIG. 5B).

8. Operations and Effects

As shown in FIGS. 5A and 5B, in the image forming apparatus 1, in a state where the LED unit 7 is located at the second position, the LED unit 7 is farther away from the photosensitive drum 50 and is closer to the first side wall 20 in the first direction than a state where the LED unit 7 is located at the first position.

Thus, as shown in FIGS. 2 and 3, when the drawer 10 supporting the drum unit 5 is moved between the inside position and the outside position in a state where the LED unit 7 is located at the second position, a contact of the LED unit 7 with the drum unit 5 and the development unit 6 can be suppressed. As a result, in the image forming apparatus 1 including the drawer 10 and the LED unit 7, interference of the LED unit 7 with the movement of the drawer 10 can be suppressed.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

a housing including a first side wall having a first opening and a second side wall arranged spaced away from the first side wall in a first direction;

a drum cartridge including a photosensitive drum;

a drawer configured to detachably support the drum cartridge, the drawer being configured to move through the first opening between an inside position at which the drawer is located inside the housing and an outside position at which the drawer is located outside the housing, the drum cartridge being attachable to or detachable from the drawer when the drawer is located at the outside position, and the drum cartridge being unattachable to or undetachable from the drawer when the drawer is located at the inside position;

an LED unit configured to move between:

a first position at which the LED unit exposes the photosensitive drum; and a second position at which the LED unit is farther away from the photosensitive drum than at the first position and the LED unit is closer to the first side wall in the first direction than at the first position;

a waste toner storage portion configured to store waste toner removed from the photosensitive drum; and a toner storage portion configured to store toner supplied to the photosensitive drum, wherein the waste toner storage portion is located below the toner storage portion in a state where the drum cartridge and the toner storage portion are arranged in the housing;

wherein the drum cartridge includes:

a pair of side plates spaced from each other in an axial direction of the photosensitive drum, the pair of side plates rotatably supporting both ends of the photosensitive drum in the axial direction; and a waste-toner conveyance pipe configured to convey waste toner from the photosensitive drum to the waste toner storage portion;

wherein the waste toner storage portion is supported by the pair of side plates and extends between the pair of side plates; and wherein the waste toner storage portion is connected to the waste-toner conveyance pipe.

2. The image forming apparatus according to claim 1, wherein the LED unit is configured to move upward as the LED unit moves from the first position toward the second position; and wherein the drawer is configured to move downward as the drawer moves from the inside position toward the outside position.

3. The image forming apparatus according to claim 2, wherein the housing includes:

a discharge portion having a discharge opening configured to discharge a sheet; and a discharge tray on which the sheet discharged from the discharge opening is placed, the discharge tray having a second opening for cleaning a light emitting surface of the LED unit; and wherein, as the LED unit moves from the first position toward the second position, the LED unit moves closer to the second opening.

4. The image forming apparatus according to claim 1, further comprising a first cover configured to move between a first open position at which the first opening is open and a first closed position at which the first opening is closed, wherein the housing includes a guide configured to guide movement of the LED unit;

wherein the guide includes a first end at which the LED unit at the first position is located and a second end at which the LED unit at the second position is located; and wherein, in a state where the first cover is located at the first closed position, at least part of the toner storage portion is located between the first cover and the second end.

5. The image forming apparatus according to claim 1, wherein the toner storage portion includes:

a first toner storage portion extending in the first direction; and a second toner storage portion extending from the first toner storage portion in a vertical direction perpendicular to the first direction.

6. The image forming apparatus according to claim 5, wherein the housing includes an upper frame arranged above the toner storage portion; and wherein the LED unit is configured to move between the first position and the second position in a space surrounded by the first toner storage portion, the second toner storage portion, and the upper frame.

7. The image forming apparatus according to claim 5, wherein a length of the first toner storage portion in the first direction is longer than a length of the second toner storage portion in the vertical direction.

8. The image forming apparatus according to claim 1, further comprising:

a sheet cassette configured to slidably move relative to the housing; and a toner storage portion configured to store toner supplied to the photosensitive drum, wherein the sheet cassette is arranged below the toner storage portion in a state where the toner storage portion is arranged in the housing.

9. The image forming apparatus according to claim 1, further comprising a development unit, wherein the development unit includes a development roller and a toner storage portion configured to store toner supplied to the photosensitive drum, the development unit being detachably supported by the drum cartridge.

10. The image forming apparatus according to claim 1, wherein the LED unit is located above the drawer in a state where the drawer is located at the inside position; and wherein the LED unit is configured to move upward as the LED unit moves from the first position toward the second position.

11. The image forming apparatus according to claim 1, wherein the LED unit is located above the drawer in a state where the drawer is located at the inside position; and wherein the drawer is configured to move downward as the drawer moves from the inside position toward the outside position.

12. The image forming apparatus according to claim 1, further comprising: a first cover configured to move between a first open position at which the first opening is open and a first closed position at which the first opening is closed; and a link member having one end and an other end, the one end being rotatably connected to the first cover, the other end being rotatably connected to the LED unit, wherein, in a state where the first cover is located at the first closed position, the LED unit is located at the first position; and wherein, in a state where the first cover is located at the first open position, the LED unit is located at the second position.

* * * * *